US012644446B2

(12) United States Patent
Seo

(10) Patent No.: US 12,644,446 B2
(45) Date of Patent: Jun. 2, 2026

(54) HEAD MODULE FOR AIR COMPRESSOR AND AIR COMPRESSOR INCLUDING SAME

(71) Applicant: MDX Co., Ltd., Gangneung-si (KR)

(72) Inventor: Eun Hye Seo, Gangneung-si (KR)

(73) Assignee: MDX Co., Ltd., Gangneung-si (KR)

( * ) Notice: Subject to any disclaimer, the term of this patent is extended or adjusted under 35 U.S.C. 154(b) by 50 days.

(21) Appl. No.: 18/741,952

(22) Filed: Jun. 13, 2024

(65) Prior Publication Data

US 2025/0382953 A1 Dec. 18, 2025

(51) Int. Cl.

| | |
|---|---|
| ***F04B 39/06*** | (2006.01) |
| ***F04B 39/00*** | (2006.01) |
| ***F04B 39/10*** | (2006.01) |
| ***F04B 39/12*** | (2006.01) |
| ***F04B 39/16*** | (2006.01) |

(52) U.S. Cl.

CPC ..... *F04B 39/066* (2013.01); *F04B 39/1033* (2013.01); *F04B 39/128* (2013.01); *F04B 39/16* (2013.01); *F04B 39/0094* (2013.01)

(58) Field of Classification Search

None

See application file for complete search history.

(56) References Cited

U.S. PATENT DOCUMENTS 1,147,350 A * 7/1915 Wikander ..... F16K 15/12 137/516.23

2,539,896 A * 1/1951 Dalrymple ..... F04B 39/16 55/400

(Continued)

FOREIGN PATENT DOCUMENTS

CN 115750282 A * 3/2023

KR 10-2021-0074884 A 6/2021

OTHER PUBLICATIONS

Translation CN202211453383 Chen (Obtained from USPTO Search) (Year: 2025).*

*Primary Examiner* — Dominick L Plakkoottam

*Assistant Examiner* — Geoffrey S Lee

(74) *Attorney, Agent, or Firm* — NKL LAW; Jae Youn Kim

(57) ABSTRACT

Provided are a heat module for an air compressor, in which introduction of foreign substances into a stroke space in which a crankshaft and a piston assembly are accommodated is completely blocked, and leakage of noise generated from the stroke space to the outside is minimized, and an air compressor including the same. The head module for the air compressor includes a crankshaft configured to receive power from the outside so as to rotate, a piston assembly including a connecting rod coupled to the crankshaft and a piston configured to reciprocate by the connecting rod, a crank body in which the crankshaft is accommodated, a cylinder assembly which is coupled to the crank body to communicate with the crank body and in which the piston is disposed, a valve unit accommodated in the cylinder assembly and configured to be opened and closed according to the reciprocating motion of the piston, a filtration filter coupled to the cylinder assembly and configured to filter air introduced into the cylinder assembly, and a cooling fan coupled to the crankshaft and disposed on an end of the crank body to rotate by the crankshaft so that unfiltered air is introduced into the crank body.

3 Claims, 15 Drawing Sheets

(56) References Cited

U.S. PATENT DOCUMENTS

| | | | | | |
|---|---|---|---|---|---|
| 4,190,402 | A * | 2/1980 | Meece | F04B 35/04 | 92/155 |
| 4,350,475 | A * | 9/1982 | Meece | F04B 27/00 | 417/238 |
| 4,373,876 | A * | 2/1983 | Nemoto | F01B 1/08 | 417/539 |
| 5,020,973 | A * | 6/1991 | Lammers | F04B 39/104 | 417/256 |
| 5,080,565 | A * | 1/1992 | Schultz | F04B 39/0016 | 137/516.21 |
| 5,171,135 | A * | 12/1992 | Gannaway | F04B 39/0016 | 251/64 |
| 5,584,675 | A * | 12/1996 | Steurer | F04B 39/066 | 417/372 |
| 6,474,954 | B1 * | 11/2002 | Bell | F04B 39/126 | 417/372 |
| 9,435,329 | B2 * | 9/2016 | Kitagawa | F04B 35/06 | |
| 2007/0292282 | A1 * | 12/2007 | Schuetzle | F04B 1/0421 | 417/273 |
| 2023/0038911 | A1 * | 2/2023 | Nishido | F04B 39/0061 | |
| 2023/0204022 | A1 * | 6/2023 | Miller | F04B 27/02 | 417/311 |
| 2024/0352925 | A1 * | 10/2024 | Cho | F04B 39/0094 | |

* cited by examiner

3(31, 32, 33, 34, 35, 36)

33(331, 332, 333, 334)
35(351, 352, 353)

HEAD MODULE FOR AIR COMPRESSOR AND AIR COMPRESSOR INCLUDING SAME

BACKGROUND

The present disclosure relates to a head module for an air compressor and an air compressor including the same, and more particularly, to a non-oil type medical air compressor.

In general, air compressors are divided into positive displacement type and dynamic type.

A representative example of the displacement-type compressor is a reciprocating piston-type compressor having a cycle, in which air is suctioned and compressed and then is discharged according to an opening/closing of a reciprocating valve of the piston in a cylinder.

The dynamic-type compressor is a device that rotates a rotor at a very high speed and increases in pressure of a gas with movement due to a large flow speed obtained at this time and thus, is often used when a large flow rate is required.

This type may be further divided into a centrifugal type and an axial flow type. In addition, there are various types of compressors such as screw compressors, which compress a gas within a space in which two screws are engaged by rotation, and scroll compressors, which compress a gas between two spiral grooves by rotation.

Types of air compressors are divided into oil-injected compressors and oil-free compressors.

The oil-injected compressors uses a method of injecting oil into a cylinder to prevent frictional heat from being generated between a piston and the cylinder. This structure generates heat when the position reciprocates to vaporize the oil within the cylinder. This structure may not block the vaporized oil, and thus, the oil is discharged together in a state of being mixed with the compressed air. Thus, the oil-injected compressors are not suitable for medical purposes and are often used for industrial purposes.

The oil-free compressors do not use oil at all, but instead use bearings to perform piston movement. Thus, the oil-free compressors may obtain clean air that does not contain the oil in the discharged air. Therefore, the oil-free compressors are widely used for the medical purposes.

In the oil-free compressor according to related art, external air is introduced without filtration to generate compressed air. As a result, foreign substances are introduced into the compressor together with the external air and thus deposited on a crank and a piston, thereby causing abrasion of the crank and the piston. Thus, there is a limitation that the foreign substances are contained in the compressed air, or the crank and the piston are not accurately driven.

In addition, in the oil-free compressors according to related art, a crack case, in which a crankshaft is accommodated, and a cylinder block, in which a piston is accommodated, are provided as a single wall structure, and a suction/discharge valve, through which external air is introduced, and compressed air is discharged, is exposed to the outside, and thus, there is a limitation that operation noise of the crank and the piston and noise generated from the valve when the air is introduced and discharged are transmitted to the outside as it is.

In addition, such an oil-free compressor according to the related art is disposed in a state in which the crankshaft is completely exposed inside the crank case. Thus, the crankshaft is directly exposed to the external air introduced into a motor when the motor is driven to prevent overheating of the motor.

However, in this case, there is a limitation in that foreign substances contained in the external air adhere to the crankshaft or are introduced into the cylinder to damage the crankshaft and the piston or to be discharged together with the compressed air.

In addition, the oil-free compressor according to the related art is provided in a tubular structure having the closed crankcase.

Thus, in the related art, when assembling the device, the crank case is first coupled to the motor, and then, the crankshaft, a connecting rod, and the piston are assembled inside the crank case.

Conversely, when disassembling the device, the crankshaft, the connecting rod, and the piston are first disassembled from the inside of the crankcase, and then, the crankcase is finally disassembled from the motor.

However, in this case, as each component has to be disassembled or assembled inside the closed crank case, there is a limitation in that workability is deteriorated, precise assembly is impossible, and long working hours are required.

Prior Art Document

Patent Document (Patent Document 1) Korean Patent Publication No. 10-2021-0074884

SUMMARY

The present disclosure provides a head module for an air compressor, which completely prevents foreign substances from being introduced from the outside into a stroke space in which a crankshaft and a piston assembly are accommodated, and an air compressor including the same.

The present disclosure also provides a head module for an air compressor, which is minimizing leakage of noise generated in the stroke space to the outside, and an air compressor including the same.

The present disclosure also provides a head module for an air compressor, in which a crank case is coupled to be detachable to the outside of a piston and a crankshaft in a state in which the piston and the crankshaft are coupled to a driving motor, and an air compressor including the same.

The present disclosure also provides a head module for an air compressor, in which cooling performance is maximized through forced air circulation and direct heat dissipation, and an air compressor including the same.

The object of the present invention is not limited to the problems mentioned above, and other problems not mentioned will be clearly understood by those skilled in the art from the description below.

According to an exemplary embodiment of the present invention, a head module for an air compressor includes: a crankshaft configured to receive power from the outside so as to rotate; a piston assembly including a connecting rod coupled to the crankshaft and a piston configured to reciprocate by the connecting rod; a crank body in which the crankshaft is accommodated; a cylinder assembly which is coupled to the crank body to communicate with the crank body and in which the piston is disposed; a valve unit accommodated in the cylinder assembly and configured to be opened and closed according to the reciprocating motion of the piston; a filtration filter coupled to the cylinder assembly and configured to filter air introduced into the cylinder assembly; and a cooling fan coupled to the crankshaft and disposed on an end of the crank body to rotate by the crankshaft so that unfiltered air is introduced into the crank body, wherein the crank body includes: a first stroke space in which the crankshaft is accommodated, and the filtered air is introduced through the cylinder assembly; and a first heat dissipation space which is isolated from the first stroke space and into which the introduced unfiltered air flows through the cooling fan, wherein the cylinder assembly includes: a second stroke space communicating with the first stroke space to accommodate the piston and the valve unit; and a second heat dissipation space which is isolated from the second stroke space to communicate with the first heat dissipation space and through which the unfiltered air passing through the first heat dissipation space flows to be discharged to the outside.

The crank body may include: a tubular inner case in which the first stroke space is defined, and an inner communication hole, through which the first stroke space and the second stroke space communicate with each other, is defined in an outer surface thereof; a foreign substance inflow prevention cover coupled to an end of the inner case to close the end of the inner case and configured to support the crankshaft; a tubular outer case which surrounds a circumference of the inner case, in which the first heat dissipation space is defined, and a mount through which the first heat dissipation space and the second heat dissipation space communicate with each other and to which the cylinder assembly is coupled is disposed on an outer surface thereof, and which has one end closed by the inner case; and a fan cover which is coupled to the other end of the outer case to protect the cooling fan disposed inside the outer case and in which a spiral grill configured to convert the unfiltered air introduced into the first heat dissipation space into a straight flow is disposed, wherein the cylinder assembly may include: a cylinder sleeve which communicates with the first stroke space and is disposed below the valve unit and in which the piston is disposed to be slidably movable, and the second stroke space is defined between the piston and the valve unit; a cylinder block of which a portion is coupled to the inner communication hole to surround the cylinder sleeve, and the other portion is coupled to an upper end of the mount so that one surface thereof is exposed to the outside and in which first heat dissipation holes communicating with the first heat dissipation space are defined; and a cylinder head which is coupled to an upper end of the cylinder block to fix the valve unit and in which second heat dissipation holes communicating with the first heat dissipation holes are defined, wherein the unfiltered air introduced into the outer case may sequentially pass through the first heat dissipation space, the first heat dissipation holes, and the second heat dissipation holes to release heat generated from the inner case and the cylinder sleeve to the outside by the cooling fan, and the cylinder block may be made of a metallic material that directly releases heat conducted from the sleeve to the outside.

The valve unit may include: a valve body disposed between the cylinder sleeve and the cylinder head and provided with at least one passage therein; a discharge valve coupled to the valve body and configured to open the at least one passage by pressing force when the piston moves upward within the cylinder sleeve and to close the passage by suction force when the piston moves downward within the cylinder sleeve; and an intake valve coupled to the piston and configured to close at least one air supply hole defined in the piston by pressing force when the piston moves upward within the cylinder sleeve and to open the at least one air supply hole by suction force when the piston moves downward within the cylinder sleeve, wherein the discharge valve may include: a discharge support bolt member including a discharge bolt body coupled to a central portion of the valve body and a discharge bolt head disposed on an upper end of the discharge bolt body; a discharge valve disk disposed between the discharge bolt head and the valve body, supported on a top surface of the valve body to close the at least one passage when the piston moves downward, and ascending along an axial direction of the discharge bolt body to open the at least one passage when the piston moves upward; a discharge movement limiting disk which is coupled to the discharge bolt body so as to be disposed above the discharge valve disk and is in contact with a top surface of the discharge valve disk to restrict movement of the discharge valve disk when the discharge valve disk ascends; and a discharge disk support member coupled to an outer surface of the discharge bolt body and configured to support a bottom surface of the discharge movement limiting disk along an axial direction of the discharge bolt body so as to fix the discharge movement limiting disk, wherein the intake valve may include: an intake support bolt member including an intake bolt body coupled to an upper central portion of the piston and an intake bolt head disposed on an upper end of the intake bolt body; an intake valve disk disposed between the intake bolt head and the piston, supported on a top surface of the piston to close the at least one air supply hole when the piston moves upward, and ascending along an axial direction of the intake bolt body to open the at least one air supply hole when the piston moves downward; an intake movement limiting disk which is coupled to the intake bolt body so as to be disposed above the intake valve disk and is in contact with a top surface of the intake valve disk to restrict movement of the intake valve disk when the intake valve disk ascends; and an intake disk support member coupled to an outer surface of the intake bolt body and configured to support a bottom surface of the intake movement limiting disk along an axial direction of the intake bolt body so as to fix the intake movement limiting disk.

The crank body may further include: a first coupling hole passing through the inner communication hole from one end of the inner case along the axial direction of the crank body to allow a portion of the piston assembly to be accessible; a second coupling hole passing through the inside of the mount communicating with the inner communication hole from one end of the outer case along the axial direction of the crank body to allow the other portion of the piston assembly to be assessable; and an opening/closing bracket detachably coupled to the outer case to selectively open and close the second coupling hole.

The crank body may further include an integrated discharge hole communicating with the mount and configured to integrate compressed air introduced through the mount so as to discharge the integrated compressed air to the outside, wherein the mount may include a filter support groove in which a portion of the filtration filter is accommodated and supported; a guide hole communicating with the filter support groove and the first stroke space to guide the air filtered through the filtration filter to the first stroke space; a first discharge hole having one portion communicating with the cylinder block and the other portion communicating with the integrated discharge hole to guide the introduced compressed air to the integrated discharge hole through the cylinder block; and an outer communication hole through which the first heat dissipation space and the first heat dissipation holes communicate with each other, wherein the cylinder block may include: a first filter accommodation hole communicating with the first support groove so that the other portion of the filtration filter is accommodated therein; a second discharge hole communicating with the first discharge hole to guide the introduced compressed air to the first discharge hole through the cylinder head, wherein the cylinder head may include: a second filter accommodation groove communicating with the first filter accommodation hole so that the other portion of the filtration filter is accommodated therein; a delay chamber disposed above the valve unit to receive the compressed air introduced through the valve unit; a third discharge hole communicating with the delay chamber to guide the compressed air contained in the delay chamber in the first direction; and a fourth discharge hole communicating with the second discharge hole and the third discharge hole to guide the compressed air introduced through the third discharge hole in a second direction different from the first direction so as to be introduced into the second discharge hole.

The filtration filter may include: a cylindrical filter body disposed across the filter support groove, the first filter accommodation hole, and the second filter accommodation hole and configured to filter the unfiltered air introduced through an opened upper portion thereof; and an air inflow nozzle coupled to an upper end of the filter body to introduce external unfiltered air into the filter body and detachably coupled to the second filter accommodation hole, wherein the air inflow nozzle may include: a first air guide hole communicating with the outside to guide the introduced unfiltered air in the first direction; and a second air guide hole communicating with the first air guide hole and the filter body to guide the introduced unfiltered air through the first air guide hole in the second direction different from the first direction so as to be introduced into the filter body.

In accordance with another exemplary embodiment of the present invention, an air compressor includes: a tank in which compressed air is stored; a driving motor installed in the tank and configured to generate rotation force; and a head module coupled to the driving motor and configured to generate the compressed air using the rotation force of the driving motor as a power source, wherein the head module includes: a crankshaft rotating by receiving power from the driving motor to rotate; a piston assembly including a connecting rod coupled to the crankshaft and a piston configured to reciprocate by the connecting rod; a crank body which is coupled to the driving motor and in which the crankshaft is accommodated; a cylinder assembly which is coupled to the crank body to communicate with the crank body and in which the piston is disposed; a valve unit accommodated in the cylinder assembly and configured to be opened and closed according to the reciprocating motion of the piston; a filtration filter coupled to the cylinder assembly and configured to filter air introduced into the cylinder assembly; and a cooling fan coupled to the crankshaft and disposed on an end of the crank body to rotate by the crankshaft so that unfiltered air is introduced into the crank body, wherein the crank body includes: a first stroke space in which the crankshaft is accommodated, and the filtered air is introduced through the cylinder assembly; and a first heat dissipation space which is isolated from the first stroke space and into which the introduced unfiltered air flows through the cooling fan, wherein the cylinder assembly includes: a second stroke space communicating with the first stroke space to accommodate the piston and the valve unit; and a second heat dissipation space which is isolated from the second stroke space to communicate with the first heat dissipation space and through which the unfiltered air passing through the first heat dissipation space flows to be discharged to the outside.

The air compressor may further include: a motor mount unit coupled to an upper portion of the tank to support the driving motor and configured to vary in position of the driving motor along an axial direction of the driving motor; and a support coupled to a lower portion of the tank and supported on the ground to absorb and disperse vibration transmitted through the tank, wherein the mount unit may include: a base frame coupled to an upper portion of the tank; a buffer member seated on the upper portion of the base frame; a mounting bracket coupled to a bottom surface of the motor and supported on a top surface of the buffer member; and a coupling member coupled by passing through the base frame, the buffer member, and the mounting bracket and configured to fix the buffer member and the mounting bracket on the base frame, wherein the buffer member may include: a buffer tube made of an elastic material to elastically support the base frame and the mounting bracket; and a buffer coil accommodated in the buffer tube to elastically support the base frame and the mounting bracket, wherein the support may include: a support frame coupled to the bottom surface of the tank; and a support structure coupled to the support frame and supported on the ground, wherein the support frame may include: a vertical support part coupled to the bottom surface of the tank and bent in an 'S' shape so as to be elastically deformed vertically when external force is applied; and a horizontal support part which is coupled to a lower end of the vertical support part and to which the support structure is detachably coupled, wherein the support structure may include: a height-adjustable member screw-coupled to the support frame to protrude to the outside of the support frame; and a support member coupled to the height-adjustable member and supported on the ground to alleviate and disperse vibration transmitted through the support frame, wherein the support member may include: a disk-shaped first disk member coupled to the height-adjustable member; an elastic member coupled to an upper end of the first disk member to elastically support the horizontal support part, a second disk member spaced apart from the first disk member so as to be supported on the ground and having a diameter greater than that of the first disk member; a ring-shaped connection member configured to surround the first disk member and the second disk member and connect the first disk member to the second disk member; a vibration dispersion ball member provided in plurality between the first disk member and the second disk member and configured to perform a rolling motion between the first disk member and the second disk member when vibration is transmitted from the first disk member; and a plurality of auxiliary elastic members disposed along an edge of the second disk member to elastically support the horizontal support part.

The air compressor may further include a main body support unit coupled to the bottom surface of the crank body and supported on the tank to alleviate the vibration of the main body of the compressor, wherein the main body support unit may include: a length-adjustable pole assembly coupled to the bottom surface of the crank body; an elastic support member accommodated in the length-adjustable pole assembly to elastically support the length-adjustable pole assembly; and a non-slip pad made of an elastic material, coupled to an end of the length-adjustable pole assembly, and supported on an outer surface of the tank.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Figure 1:
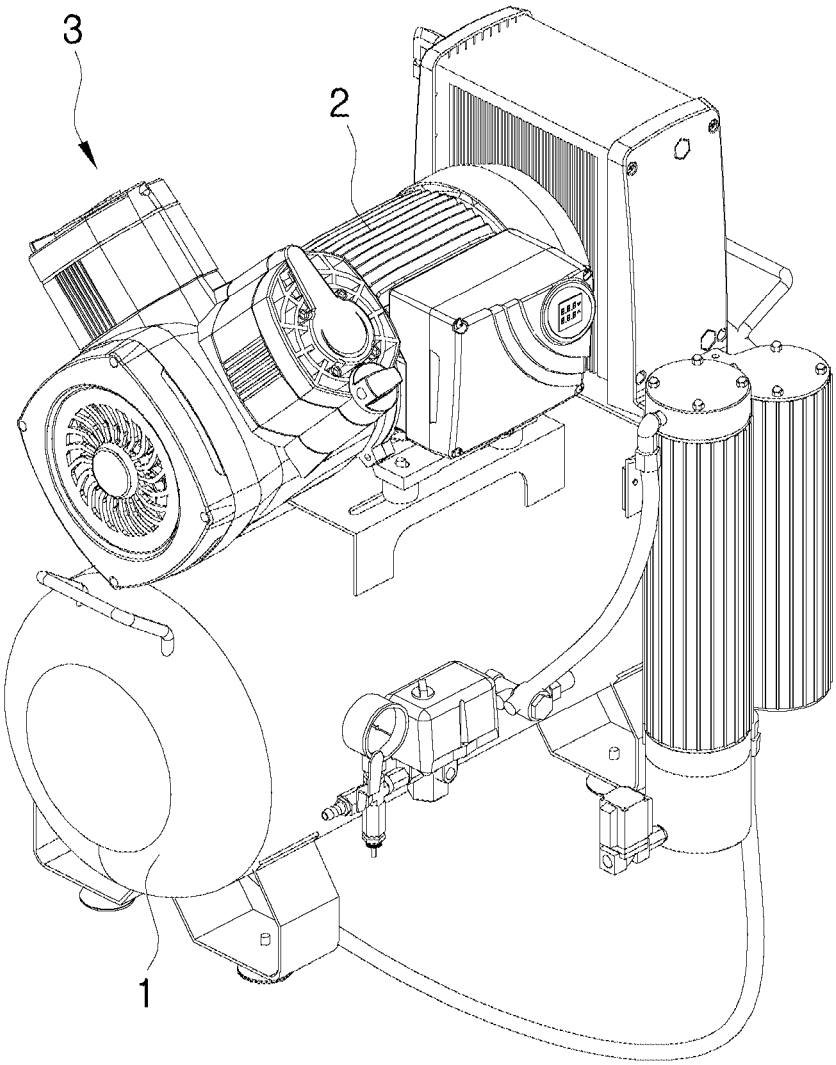
FIG. 1 is a perspective view of an air compressor according to an embodiment of the present invention.

Hereinafter, embodiments will be described in detail with reference to the accompanying drawings. However, various changes may be made to the embodiments, so the scope of rights of the patent application is not restricted or limited by these embodiments. It should be understood that all changes, equivalents, or substitutes for the embodiments are included in the scope of rights.

Specific structural or functional descriptions of the embodiments are disclosed for illustrative purposes only and may be modified and implemented in various forms. Thus, the embodiments are not limited to the specific disclosed form, and the scope of the present specification includes changes, equivalents, or substitutes included in the technical spirit.

The terms such as first or second may be used to describe various components, but these terms should be interpreted only for the purpose of distinguishing one component from another component. For example, a first component may be named a second component, and similarly, a second component may also be named a first component.

It will also be understood that when an element is referred to as being 'connected to' another element, it can be directly connected to the other element, or intervening elements may also be present.

The terms used in the embodiments are for descriptive purposes only and should not be construed as limiting. The terms of a singular form may include plural forms unless referred to the contrary. In this specification, it should be understood that the terms such as "comprise/include" or "have" are intended to designate the presence of features, numbers, steps, operations, components, parts, or combinations thereof described in the specification, but does not exclude in advance the possibility of the existence or addition of elements, numbers, steps, operations, components, parts, or combinations thereof.

Unless otherwise defined, all terms used herein, including technical or scientific terms, have the same meaning as generally understood by a person of ordinary skill in the technical field to which the embodiments belong. Terms such as terms that are generally used and have been in dictionaries should be construed as having meanings matched with contextual meanings in the art. In this description, unless defined clearly, terms are not ideally, excessively construed as formal meanings.

In addition, when describing with reference to the accompanying drawings, identical components will be assigned the same reference numerals regardless of the reference numerals, and overlapping descriptions thereof will be omitted. In describing the embodiments, if it is determined that detailed descriptions related to known technologies may unnecessarily obscure the gist of the embodiments, the detailed descriptions are omitted.

Advantages and features of the present disclosure, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims.

In the embodiments of the present invention, unless otherwise defined, all terms used herein, including technical or scientific terms, are the same as those commonly understood by a person of ordinary skill in the technical field to which the present invention pertains. Terms defined in commonly used dictionaries should be interpreted as having meanings consistent with the meanings they have in the context of the relevant technology. In this description, unless defined clearly, terms are not ideally, excessively construed as formal meanings.

Since a shape, a ratio, an angle, a number, etc., which are shown in the accompanying drawings are exemplarily illustrated, the present disclosure is not limited thereto. Moreover, detailed descriptions related to well-known functions or configurations will be ruled out in order not to unnecessarily obscure subject matters of the present disclosure. When 'comprising', 'having', 'consisting of', etc. are used, other components can be added unless 'only' is used. Even when a component is explained in singular number they may be interpreted as plural number.

In interpretation of the components, even though separate explicit expressions are not provided, they are to be interpreted as including general tolerance.

When positional relation of two portions is explained by 'on', 'upper', 'lower', 'beside', etc., one or more components may be positioned between two portions unless 'just' is not used. When portions are connected by 'or', the portions are interpreted as including 'alone' as well as 'combination thereof' but when portions are connected by 'or', 'one of', portions are interpreted as 'alone'.

When an element or layer is referred to as "on" another element or layer, it includes instances where the element or layer is directly on top of or intervening with another element. Like reference numerals refer to like elements throughout.

The size and thickness of each component shown in the drawings are shown for convenience of explanation, and the present invention is not necessarily limited to the size and thickness of the components shown.

Each feature of the various embodiments of the present invention can be partially or fully coupled or combined with each other, and as can be fully understood by those skilled in the art, various technical interconnections and operations are possible. Also, the embodiments may be independently performed with respect to each other or performed in combination of each other.

FIG. 1 is a perspective view of an air compressor according to an embodiment of the present invention.

Referring to FIG. 1, an air compressor 1000 according to an embodiment of the present invention (hereinafter, referred to as an 'air compressor 1000') includes a tank 1, a driving motor 2, and a head module 3.

The tank 1 is disposed below the driving motor 2 and the head module 3 to support the driving motor 2 and the head module 3 and stores compressed air therein.

The tank 1 may be made of a metallic material that does not rust or corrode. For example, the tank 1 may be made of an aluminum material.

The driving motor 2 is installed at an upper portion of the tank 1 and connected to the head module 3 and is configured to generate rotational force through power applied from the outside.

A tubular coupler for coupling with the head module 3 may be disposed on one end of the driving motor 2.

Here, a shielding plate that closes one opened side of the head module 3 and supports a shaft of the driving motor 2 may be disposed inside the coupler.

The head module 3 is coupled to the driving motor 2 and is configured to generate compressed air using the rotational force of the driving motor 2 as a power source.

Figure 2:
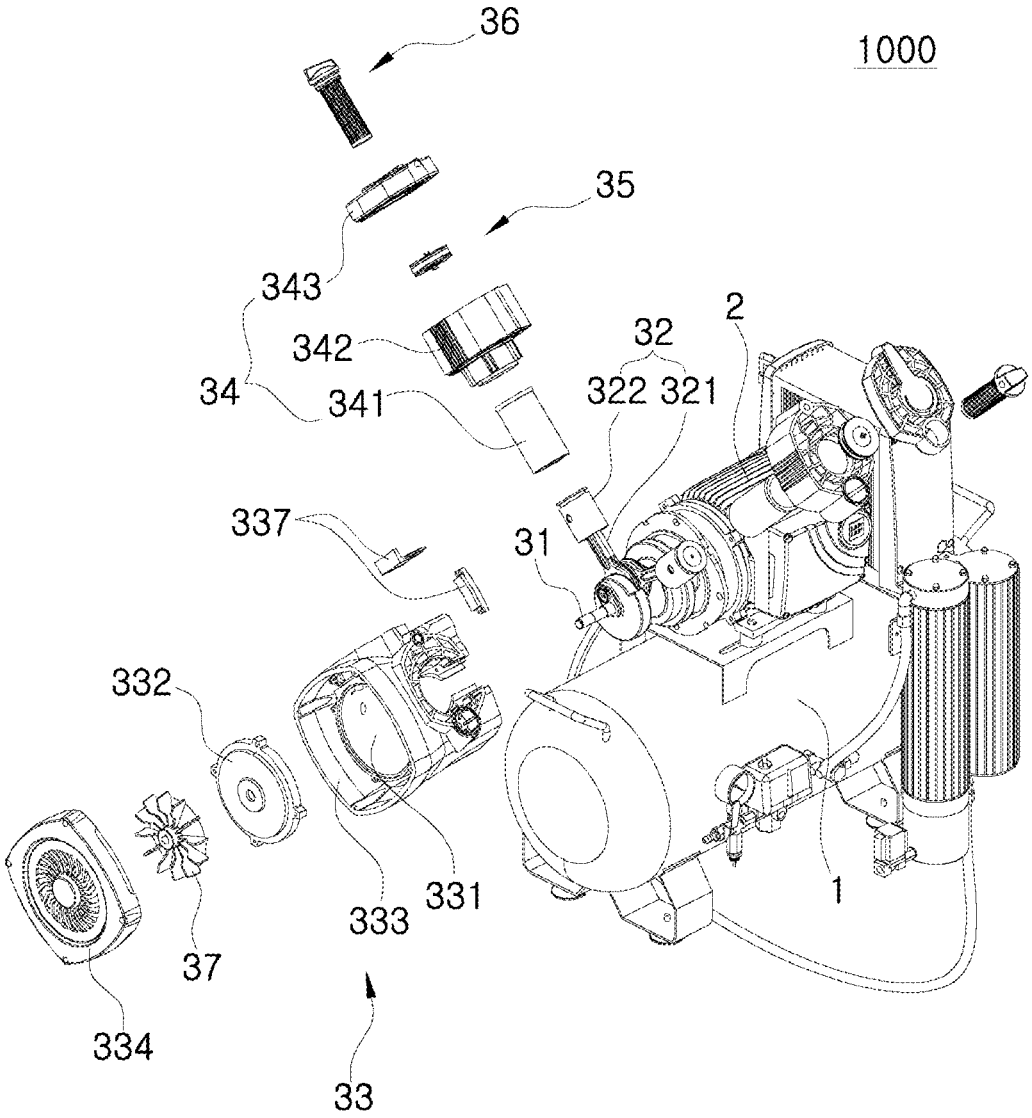
FIG. 2 is a partial exploded perspective view illustrating a state in which a head module is disassembled according to an embodiment of the present invention.
Figure 3:
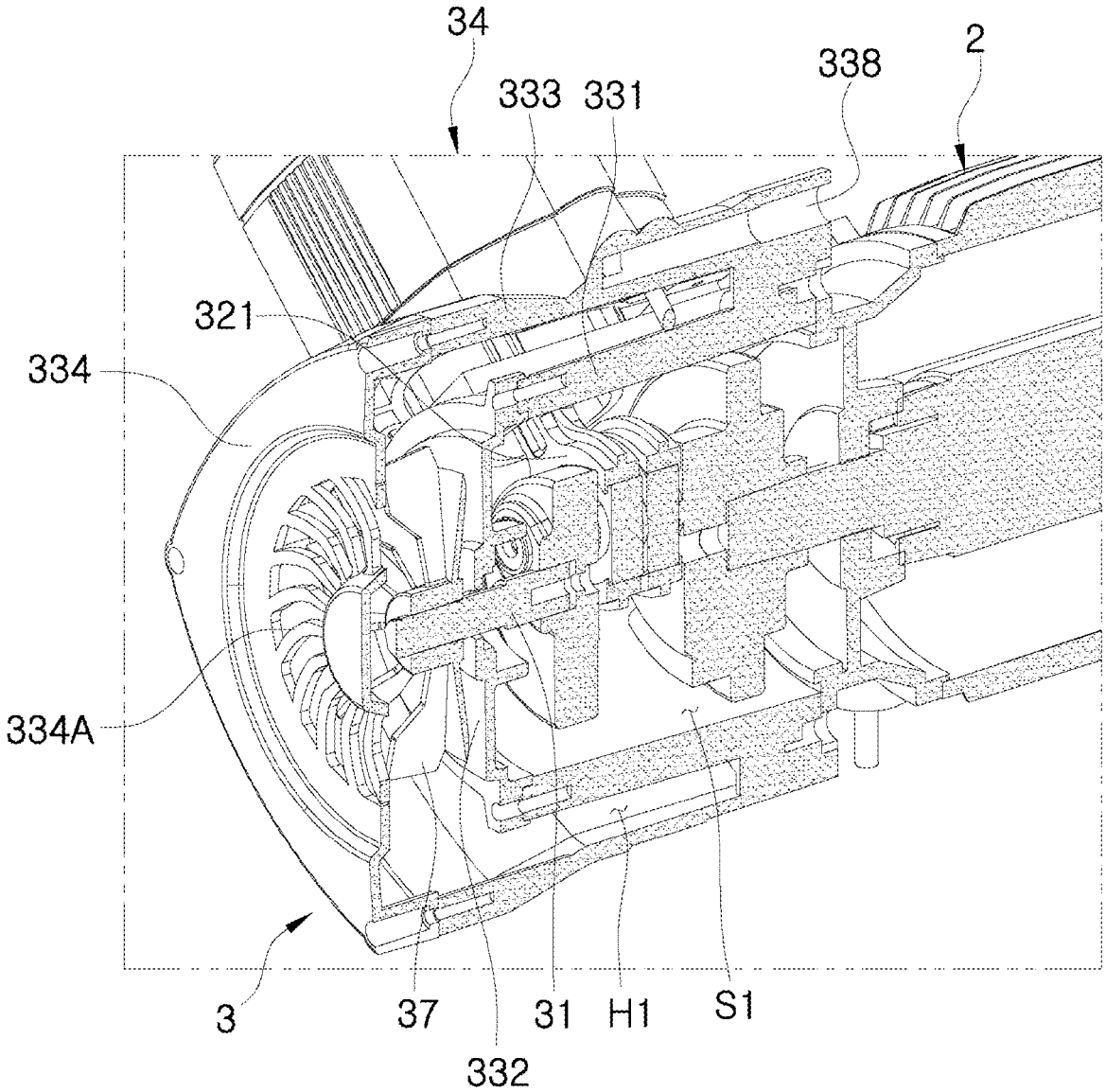
FIG. 3 is a cross-sectional view illustrating an inner structure of the head module according to an embodiment of the present invention.
Figure 4:
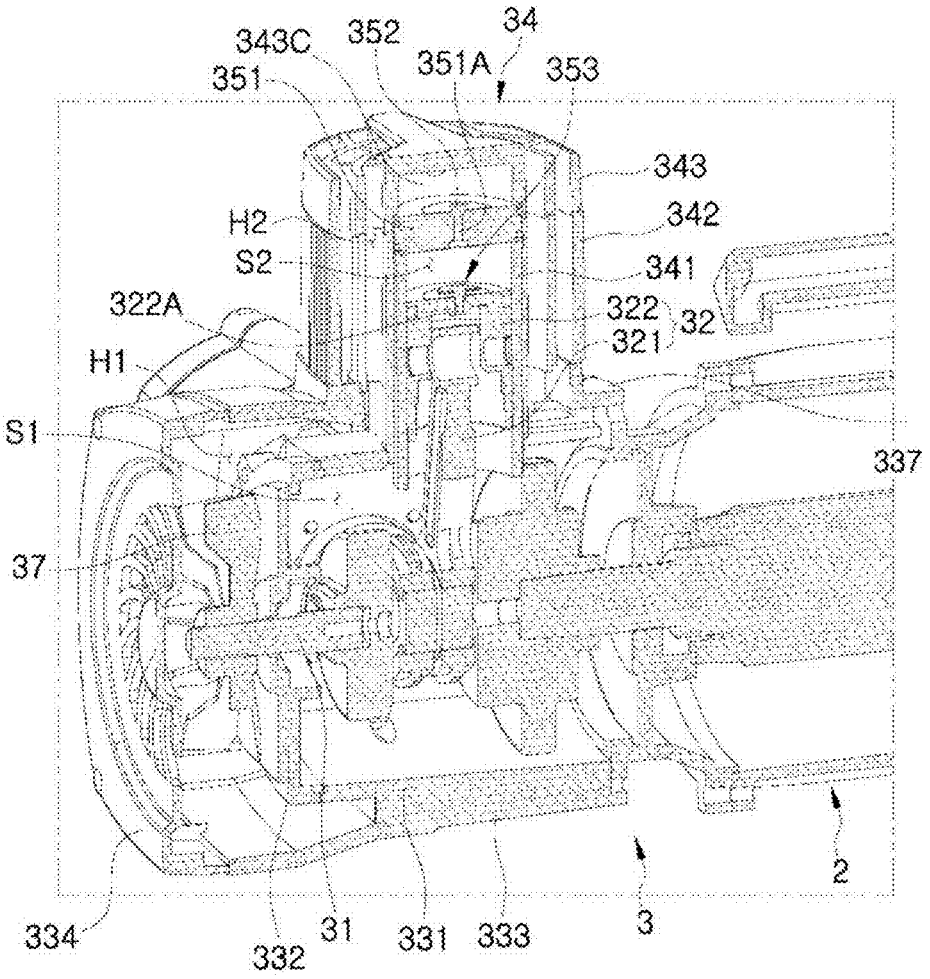
FIG. 4 is a cross-sectional view illustrating a path through which unfiltered air flows into the head module according to an embodiment of the present invention.

FIG. 2 is a partial exploded perspective view illustrating a state in which the head module is disassembled according to an embodiment of the present invention, FIG. 3 is a cross-sectional view illustrating an inner structure of the head module according to an embodiment of the present invention, and FIG. 4 is a cross-sectional view illustrating a path through which unfiltered air flows into the head module according to an embodiment of the present invention.

Referring to FIGS. 2 to 4, the head module 3 includes a crankshaft 31, a piston assembly 32, a crank body 33, a cylinder assembly 34, a valve unit 35, a filtration filter 36, and a cooling fan 37.

The crankshaft 31 is accommodated in the crank body 33 and rotates by receiving power from the outside.

In more detail, the crankshaft 31 is coupled to the driving motor 2 and rotates by receiving power from the driving motor 2.

The piston assembly 32 includes a connecting rod 321 coupled to the crankshaft 31 and performing a reciprocating motion by the crankshaft 31 and a piston 332 coupled to the connecting rod 321, accommodated in the cylinder assembly 34, and configured to compress air contained in the cylinder assembly 34 while performing a reciprocating motion by the connecting rod 321. For example, the piston 322 may be made of special cast iron/light alloy that withstands a high temperature and pressure and has low abrasion.

The crank body 33 is coupled to the driving motor 2, and the crankshaft 31 is accommodated in the crank body 33.

The crank body 33 is provided in a double-wall structure to define a plurality of spaces isolated from each other therein.

Specifically, the crankshaft 31 is accommodated inside the crank body 33. A first stroke space S1 into which filtered air is introduced through the cylinder assembly 34 and a first heat dissipation space H1 which is isolated from the first stroke space S1 and into which introduced unfiltered air flows through a cooling fan 37 are defined inside the crank body 33.

The crank body 33 may include a crank case, a foreign substance inflow prevention cover 332, and a fan cover 334.

Figure 5:
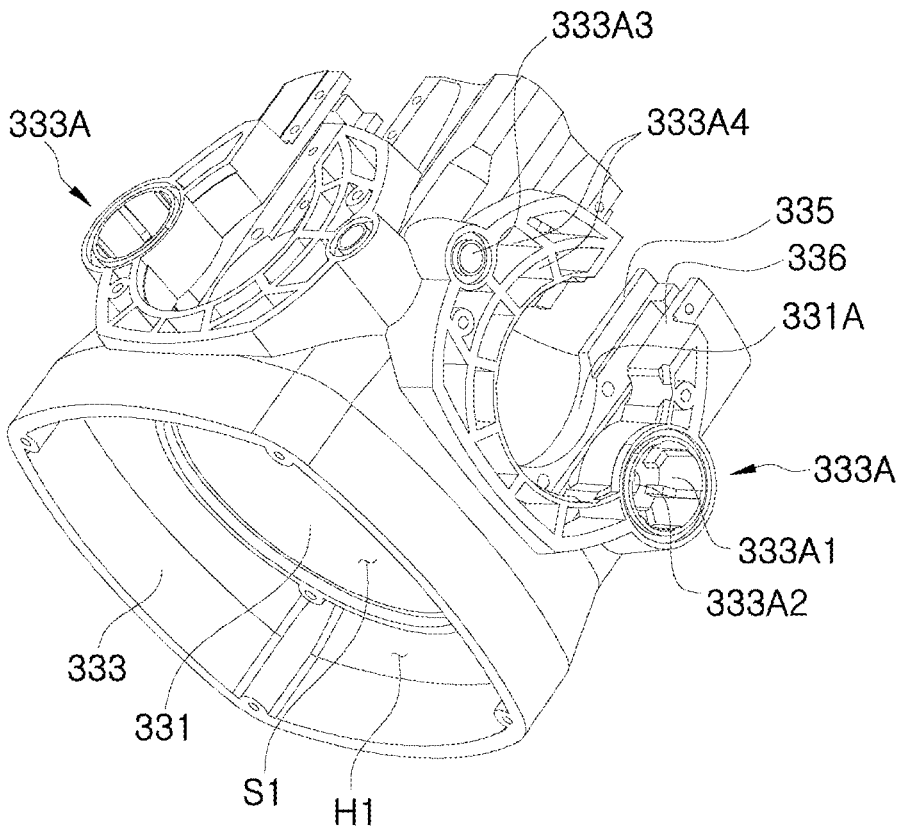
FIG. 5 is a perspective view of a crank case according to an embodiment of the present invention.
Figure 6:
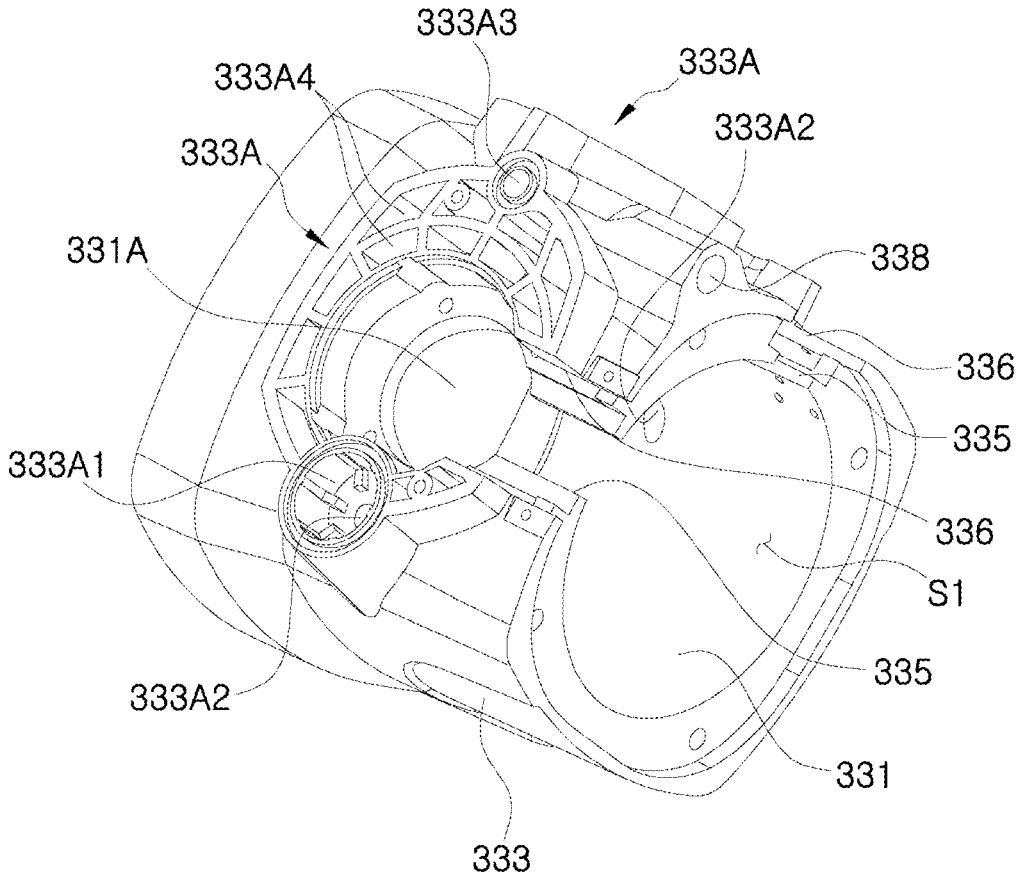
FIG. 6 is a rear perspective view illustrating a rear surface of the crank case according to an embodiment of the present invention.

FIG. 5 is a perspective view of the crank case according to an embodiment of the present invention, and FIG. 6 is a rear perspective view illustrating a rear surface of the crank case according to an embodiment of the present invention.

Referring to FIGS. 3 to 6, the crank case may include an inner case 331 and an outer case 333.

The inner case 331 is provided in a tubular shape, and the first stroke space S1 in which the crankshaft 31 is accommodated may be defined inside the inner case 331.

An inner communication hole 331A may be defined in an outer surface of the inner case 331 to allow the first stroke space S1 to communicate with a second stroke space S2 of the cylinder assembly 34 in which the piston 322 and the valve unit 35 are accommodated.

One end of the inner case 331 may be connected to the outer case 333 to shield one side of the first heat dissipation space H1 and be closed by being coupled to a coupler provided on the driving motor 2. In addition, the other end of the inner case 331 may be closed by being coupled to the foreign substance inflow prevention cover 332.

The outer case 333 may be provided in a tubular shape and also be spaced apart from the inner case 331 to surround the inner case 331 and be disposed outside the inner case 331.

Thus, the first heat dissipation space H1 may be defined inside the outer case 333, that is, between the outer case 333 and the inner case 331.

A mount 333A which allows the first heat dissipation space H1 to communicate with a second heat dissipation space H2 defined inside the cylinder assembly 34 and to which the cylinder assembly 34 is coupled may be provided on an outer surface of the outer case 333.

One end of the outer case 333 may be connected to the inner case 331 so as to be closed, and the other end of the outer case 333 may be coupled to the fan cover 334 so as to be closed.

Referring to FIGS. 2 to 4, the foreign substance inflow prevention cover 332 may be coupled to the other end of the opened inner case 331 to close the other end of the inner case 331. Thus, an inflow of foreign substances into the other end of the inner case 331 may be blocked, as well as noise may be blocked.

The foreign substance inflow prevention cover 332 may support a portion of the crankshaft 31. Thus, the crankshaft 31 may rotate stably.

The fan cover 334 may be coupled to the other end of the outer case 333 to protect the cooling fan 37 disposed inside the outer case 333 from the outside.

A spiral grill 334A that converts the unfiltered air introduced into the first heat dissipation space H1 into a straight flow may be disposed inside the fan cover 334.

The fan cover 334 may be coupled to the outer case 333 in various manners.

For example, the fan cover 334 may be coupled to the outer case 333 through a coupling means such as a bolt.

As another example, the fan cover 334 may be detachably coupled to the outer case 333 through magnetic force.

Specifically, wedge-shaped coupling protrusions, each of which protrudes outward and has a width gradually decreasing in a protruding direction, may be disposed on one surface of the fan cover 334 that is in contact with the end of the outer case 333. In addition, a coupling magnet may be disposed on an end of each of the coupling protrusions. Here, coupling grooves, each of which has a shape corresponding to each of the wedge-shaped coupling protrusions, may be defined in the end of the outer case 333 coupled to the fan cover 334, and a magnetic material that is detachably coupled to the coupling magnet through magnetic force may be disposed on an end of each of the coupling grooves.

Thus, a user may quickly couple or separate the fan cover 334 to/from the outer case 333.

Referring to FISG. 2 and 4, the cylinder assembly 34 is coupled to the crank body 33 to communicate with the crank body 33.

The piston 322 is disposed inside the cylinder assembly 34.

The cylinder assembly 34 is provided in a double-wall structure to define a plurality of spaces isolated from each other therein.

Specifically, the second stroke space S2 which communicates with the first stroke space S1 and in which the piston 322 and the valve unit 35 are accommodated is defined inside the cylinder assembly 34. In addition, the second heat dissipation space H2 which is isolated from the second stroke space S2 to communicate with the first heat dissipation space H1 and through which the unfiltered air passing through the first heat dissipation space H1 flows to be discharged to the outside is defined inside the cylinder assembly 34.

The cylinder assembly 34 may include a cylinder sleeve 341, a cylinder block 342 and a cylinder head 343.

The cylinder sleeve 341 may be disposed below the valve unit 35 in communication with the first stroke space S1.

The piston 322 may be disposed to be slidably movable inside the cylinder sleeve 341.

Thus, the second stroke space S2 may be defined between the piston 322 and the valve unit 35.

For example, the cylinder sleeve 341 may be made of special cast iron/light alloy that withstands a high temperature and pressure and has low abrasion.

Figure 7:
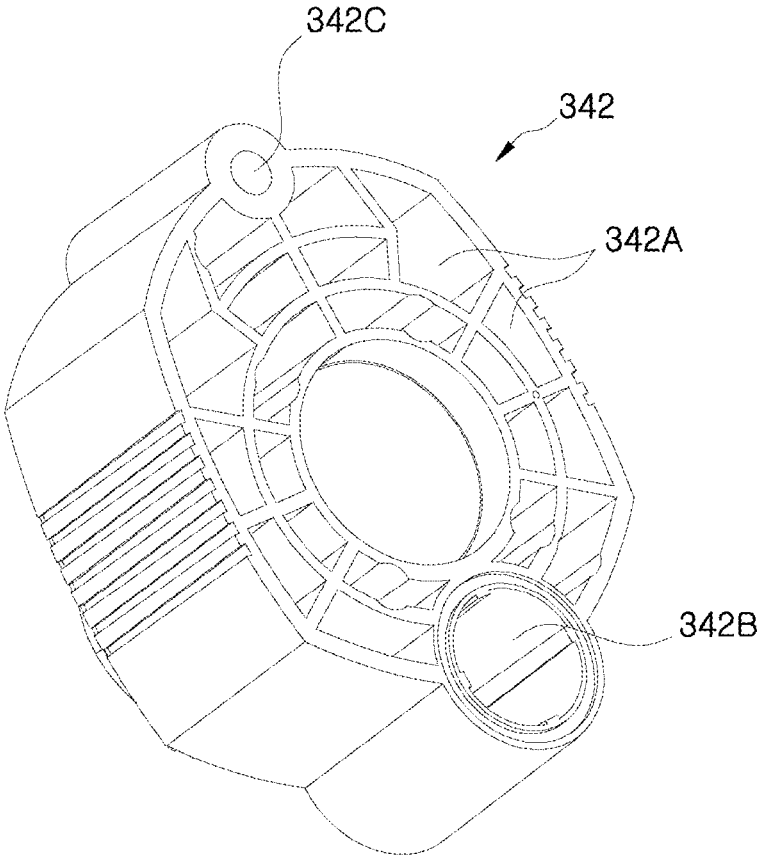
FIG. 7 is a perspective view of a cylinder block according to an embodiment of the present invention.

FIG. 7 is a perspective view of the cylinder block according to an embodiment of the present invention.

Referring to FIGS. 4 and 7, a portion of the cylinder block 342 may be coupled to an inner communication hole 331A to surround the cylinder sleeve 341, and the other portion of the cylinder block 342 may be coupled to an upper end of the mount 333A so that one side thereof is exposed to the outside.

First heat dissipation holes 342A that communicate with the first heat dissipation space H1 to define a portion of the second heat dissipation space H2 may be defined inside the cylinder block 342.

The cylinder block 342 may be made of a metallic material that directly releases heat conducted from the cylinder sleeve 341 to the outside. For example, the cylinder block 342 may be made of aluminum or copper or may include at least one of aluminum or copper.

Here, a plurality of heat dissipation slots may be defined in an outer surface of the cylinder block 342 to maximize heat dissipation performance. Thus, a heat dissipation area may increase to maximize the heat dissipation performance.

Figure 8A:
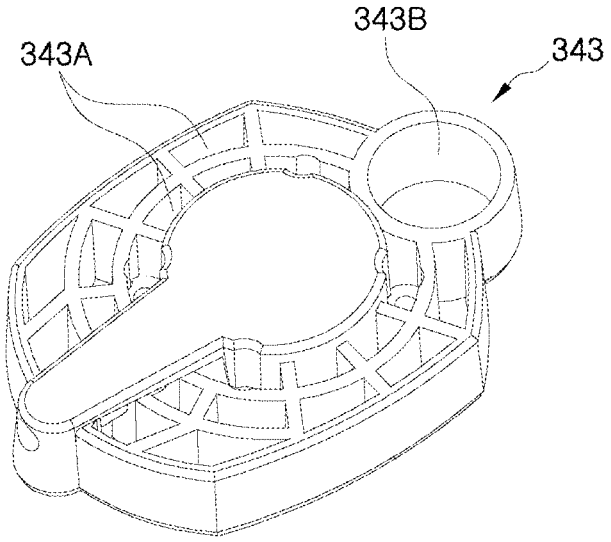
FIG. 8A is a perspective of a cylinder head according to an embodiment of the present invention.
Figure 8B:
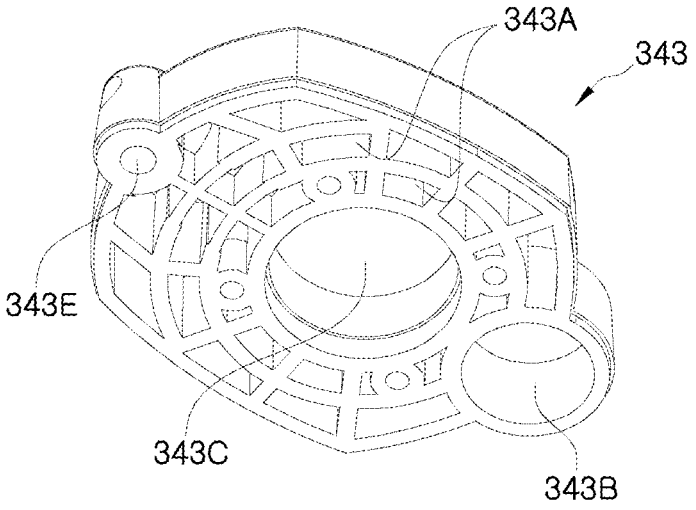
FIG. 8B is a bottom perspective view of the cylinder head according to an embodiment of the present invention.

FIG. 8A is a perspective of the cylinder head according to an embodiment of the present invention, and FIG. 8B is a bottom perspective view of the cylinder head according to an embodiment of the present invention.

Referring to FIGS. 4, 8A, and 8B, the cylinder head 343 may be coupled to an upper end of the cylinder block 342 to fix the valve unit 35.

Second heat dissipation holes 343A that communicate with the first heat dissipation holes 342A to define a remaining portion of the second heat dissipation space H2 may be defined inside the cylinder head 343.

Thus, the unfiltered air introduced into the outer case 333 by the cooling fan 37 may sequentially pass through the first heat dissipation space H1, the first heat dissipation holes 342A, and the second heat dissipation holes 343A to release heat generated from the inner case 331 and the cylinder sleeve 341 to the outside.

Figure 9:
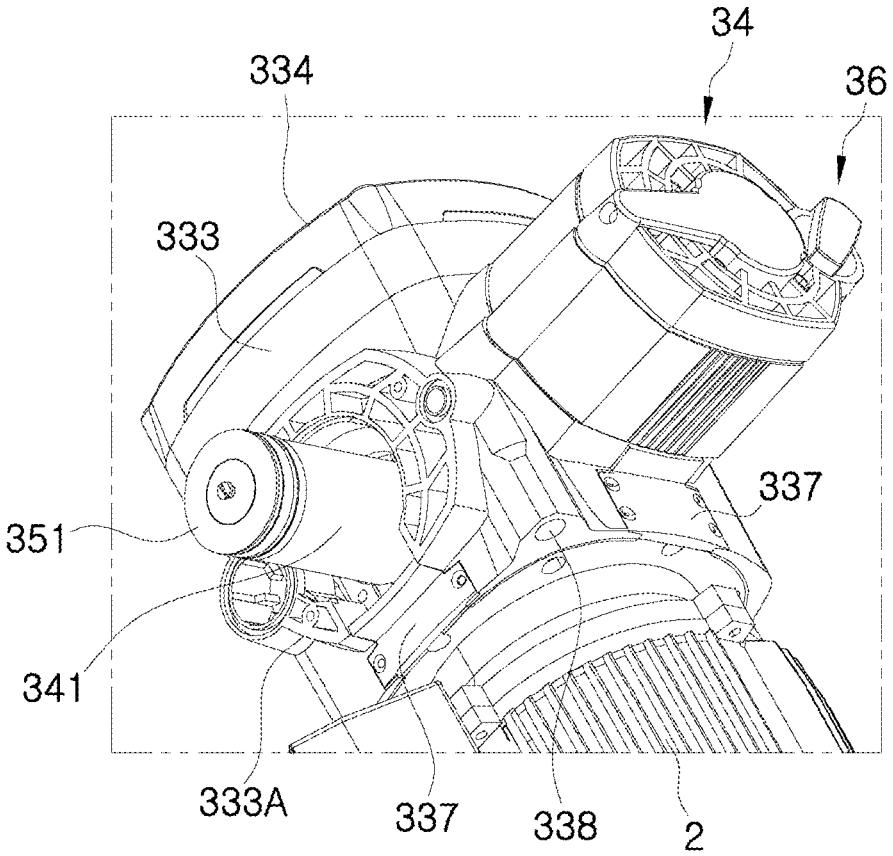
FIG. 9 is a perspective view illustrating a state in which the crank case is coupled to the outside of a piston assembly coupled to a motor according to an embodiment of the present invention.

FIG. 9 is a perspective view illustrating a state in which the crank case is coupled to the outside of the piston assembly coupled to the motor according to an embodiment of the present invention.

Referring to FIGS. 2 and 9, the crank body 33 may be configured to be detachably coupled to the driving motor 2 in the state in which the crankshaft 31 and the piston assembly 32 coupled to the driving motor 2.

Referring to FIGS. 2, 5, 6, and 9, the crank body 33 may further include a first coupling hole 335, a second coupling hole 336, and an opening/closing bracket 337.

The first coupling hole 335 may pass through the inner communication hole 331A from one end of the inner case 331 to which the driving motor 2 is coupled along an axial direction of the crank body 33.

Thus, when the crank body 33 is coupled to or separated from the driving motor 2, a portion of the piston assembly 32 may be accessible through the first coupling hole 335.

The second coupling hole 336 may pass through the inside of the mount 333A communicating with the inner communication hole 331A from one end of the outer case 333 along the axial direction of the crank body 33.

Thus, when the crank body 33 is coupled to or separated from the driving motor 2, the other portion of the piston assembly 32 may be accessible through the second coupling hole 336.

The opening/closing bracket 337 may be detachably coupled to the outer case 333 to selectively open and close the second coupling hole 336.

Figure 10:
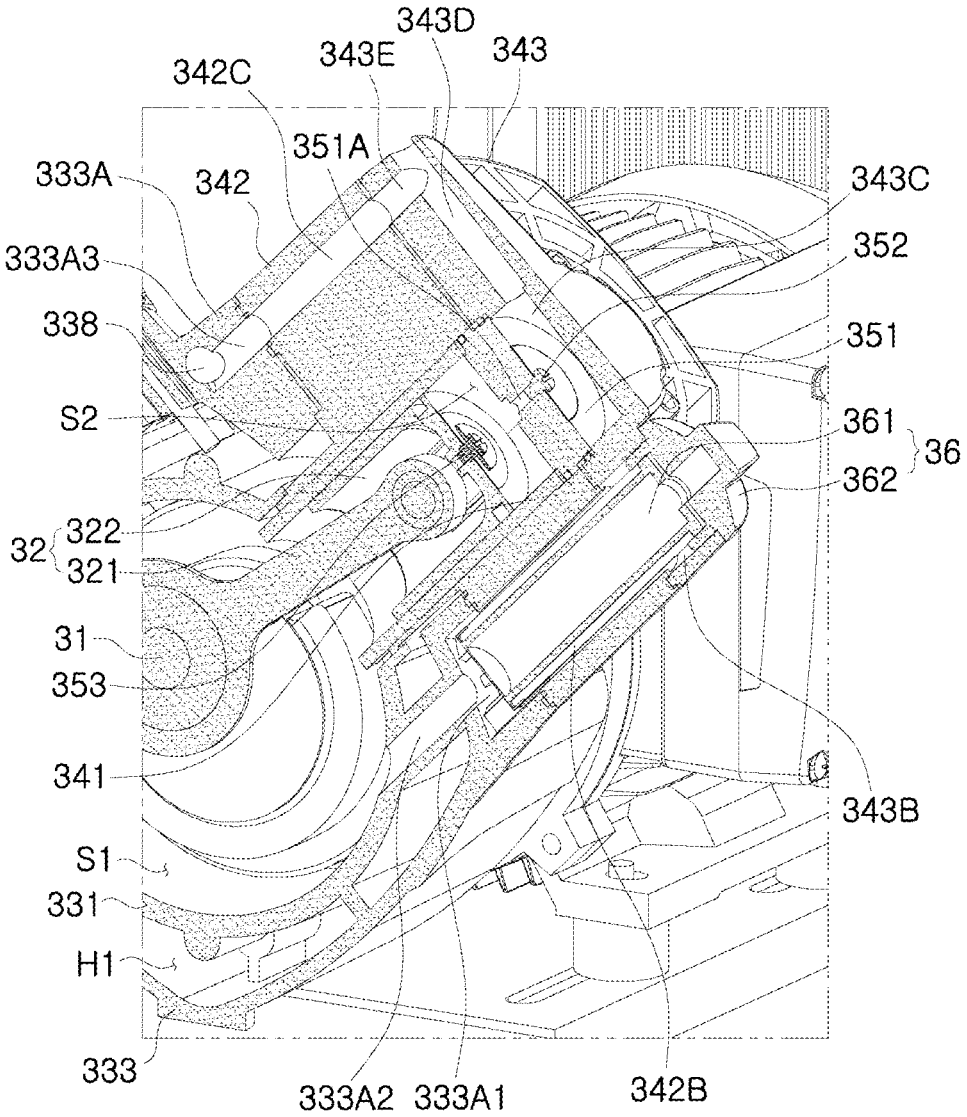
FIG. 10 is a cross-sectional view illustrating an inner structure of the cylinder assembly according to an embodiment of the present invention.

FIG. 10 is a cross-sectional view illustrating the inner structure of the cylinder assembly according to an embodiment of the present invention.

Referring to FIGS. 3, 6, and 10, the crank body 33 may further include an integrated discharge hole 338.

The integrated discharge hole 338 may communicate with the mount 333A to integrate compressed air introduced through the mount 333A so as to discharge the integrated air to the outside.

Here, referring to FIGS. 6 and 10, the mount 333A may include a filter support groove 333A1 in which a portion of the filtration filter 36 is accommodated and supported, a guide hole 333A2 that communicates with the filter support groove 333A1 to guide air filtered through the filtration filter 36 to the first stroke space S1, a first discharge hole 333A3 having a portion communicating with the cylinder block 342 and the other portion communicating with the integrated discharge hole 338 to guide the compressed air introduced inside through the cylinder block 342 to the integrated discharge hole 338, and outer communication holes 333A4 communicating with the first heat dissipation space H1 and the first heat dissipation holes 342A.

In addition, referring to FIGS. 10, the cylinder block 342 may include a first filter accommodation groove 342B communicating with the filter support groove 333A1 to accommodate the other portion of the filtration filter 36 therein and a second discharge hole 342C communicating with the first discharge hole 333A3 to guide the compressed air introduced through the cylinder head 343 to the first discharge hole 333A3.

In addition, referring to FIGS. 8 and 10, the cylinder head 343 may include a second filter accommodation hole 343B communicating with the first filter accommodation hole 342B to accommodate another portion of the filtration filter 36 therein, a delay chamber 343C disposed above the valve unit 36 to receive the compressed air introduced through the valve unit 35, a third discharge hole 343D communicating with the delay chamber 343C to guide the compressed air received in the delay chamber 343C in the first direction, and a fourth discharge hole 343E communicating with the second discharge hole 342C and the third discharge hole 343D to guide the compressed air introduced through the third discharge hole 343D in a second direction different from the first direction so that the compressed air is introduced into the second discharge hole 342C.

Referring to FIGS. 2 and 4, the valve unit 35 is accommodated in the cylinder assembly 34 and is configured to be opened and closed according to reciprocating movement of the piston 322.

Figure 11:
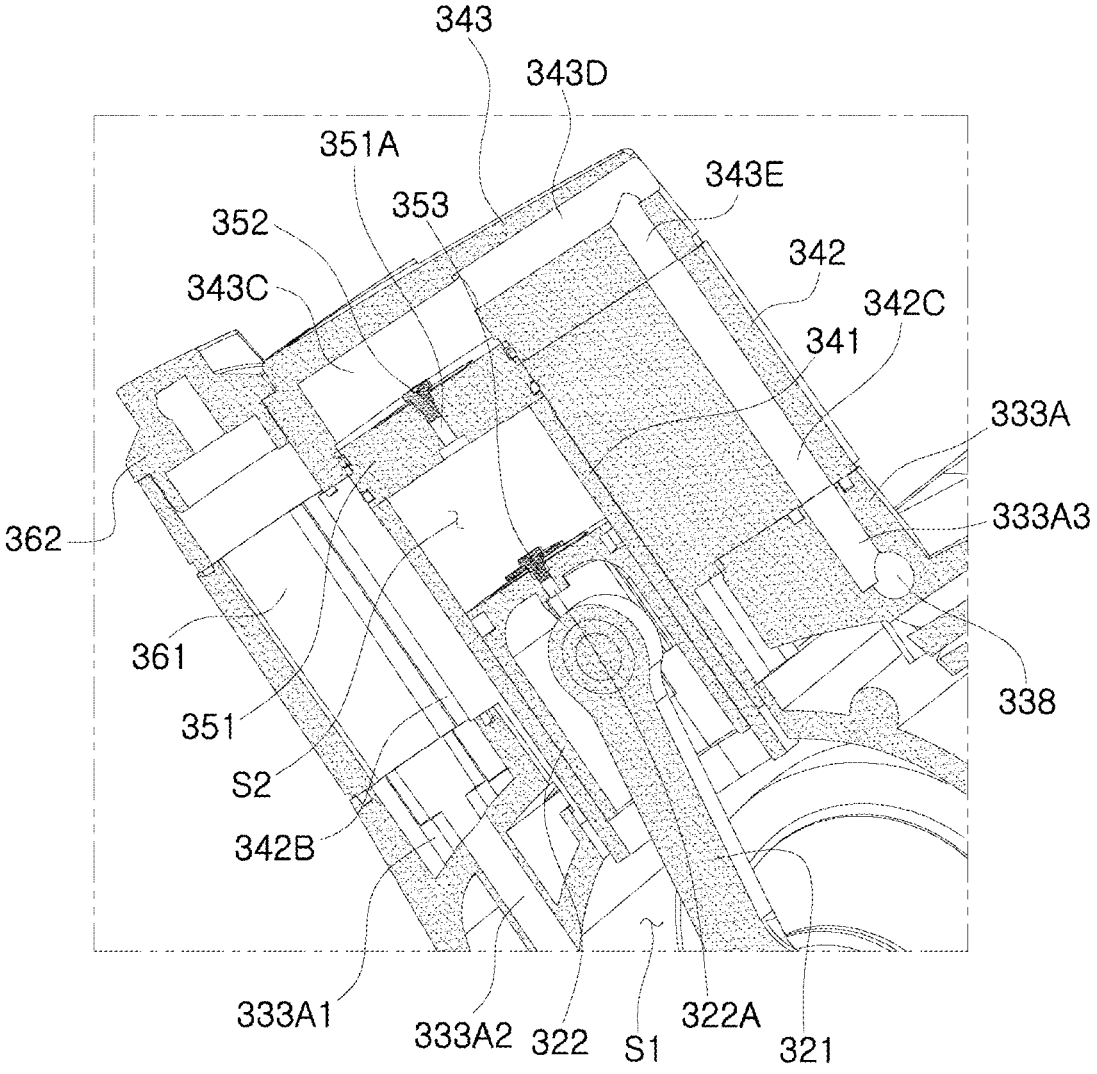
FIG. 11 is a cross-sectional view of a valve unit according to an embodiment of the present invention.

FIG. 11 is a cross-sectional view of the valve unit according to an embodiment of the present invention.

Referring to FIG. 11, the valve unit 35 may include a valve body 351, a discharge valve 352, and an intake valve 353.

The valve body 351 may be disposed between the cylinder sleeve 341 and the cylinder head 343.

At least one passage 351A through which the second stroke space S2 and the delay chamber 343C communicate with each other may be provided inside the valve body 351. For example, a sealing ring made of an elastic material may be coupled to an outer surface of the valve body 351. In addition, the valve body 351 may be made of alloy steel such as stainless steel, nickel chromium steel, or nickel molybdenum steel.

The discharge valve 352 may be coupled to the valve body 351 to open and close the passage 351A by the reciprocating movement of the piston 322.

Specifically, when the piston 322 moves upward within the cylinder sleeve 341, the discharge valve 352 may open at least one passage 351A by pressing force to introduce the compressed air within the second stroke space S2 into the delay chamber 343C, and when the piston 322 moves downward within the cylinder sleeve 341, the discharge valve 352 may close at least one passage 351A by suction force.

Figure 13:
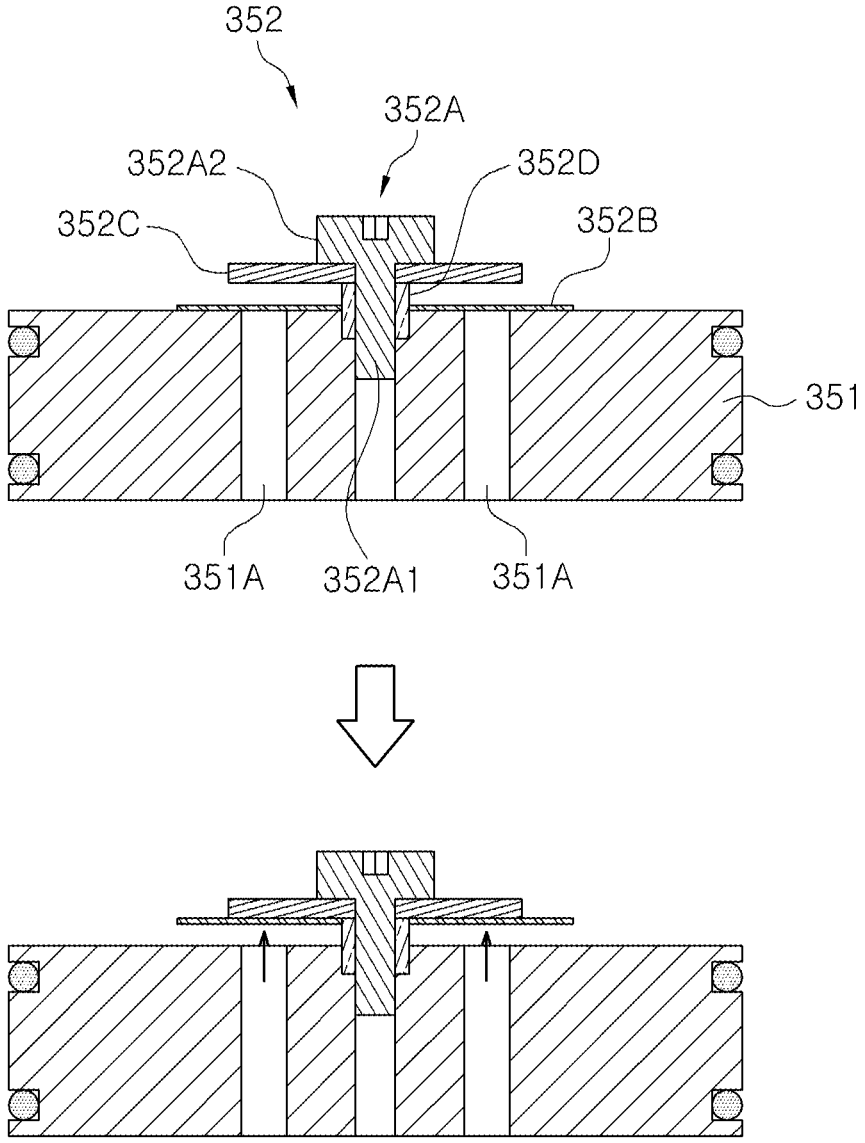
FIG. 13 is a schematic view illustrating a process of opening and closing a discharge valve according to an embodiment of the present invention.

FIG. 13 is a schematic view illustrating a process of opening and closing the discharge valve according to an embodiment of the present invention.

Referring to FIG. 13, the discharge valve 352 may include a support bolt member 352A for discharging (hereinafter, referred to as a discharge support bolt member 352A), a valve disk 352B for discharging (hereinafter, referred to as a discharge valve disk 352B), a movement limiting disk 352C for discharging (hereinafter, referred to as a discharge movement limiting disk 352C), and a disk support member 352D for discharging (hereinafter, referred to as a discharge disk support member 352D).

The discharge support bolt member 352A may include a discharge bolt body 352A1 coupled to a central portion of the valve body 351 and a discharge bolt head 352A2 disposed on an upper end of the discharge bolt body 352A1.

The discharge valve disk 352B may be disposed between the discharge bolt head 352A2 and the valve body 351.

When the piston 322 moves downward, the discharge valve disk 352B may be supported on a top surface of the valve body 351 to close at least one passage 351A, and when the piston 322 moves upward, the discharge valve disk 352B may ascend along an axial direction of the discharge bolt body 352A1 to open at least one passage 351A.

The discharge movement limiting disk 352C may be coupled to the discharge bolt body 352A1 and be disposed above the discharge valve disk 352B.

When the discharge valve disk 352B ascends, the discharge movement limiting disk 352C may be in contact with a top surface of the discharge valve disk 352B to restrict the movement of the discharge valve disk 352B.

Here, the discharge movement limiting disk 352C may have a predetermined diameter so as to be in sufficient contact with the top surface of the discharge valve disk 352B to stably support the discharge valve disk 352B.

For example, a relative ratio of the diameter of the discharge valve disk 352B to a diameter of the discharge movement limiting disk 352C may be about 1:1 or more and about 1:1.4 or less.

Thus, a sufficient support area of the discharge movement limiting disk 352C with respect to the discharge valve disk 352B may be secured to prevent the discharge valve disk 352B from being deformed and damaged and minimize noise generated when contacting the discharge movement limiting disk 352C.

If the discharge movement limiting disk 352C is not provided, the ascending discharge valve disk 352B is hung and supported by the discharge bolt head 352A2. However, in this case, the sufficient support area may not be secured due to the relatively small diameter of the discharge bolt head 352A2, and thus, whenever the discharge valve disk 352B is in contact with the discharge bolt head 352A2, a pressure of the discharge valve disk 352A2 may be applied to be concentrated to a central portion of the discharge valve disk 352B. Thus, the central portion of the discharge valve disk 352*b* may be bent and deformed to cause cracks and noise.

The discharge disk support member 352D may be coupled to an outer surface of the discharge bolt body 352A1 to support a bottom surface of the discharge movement limiting disk 352C along the axial direction of the discharge bolt body 352A1.

Thus, the discharge disk support member 352D may fix the discharge movement limiting disk 352C.

The intake valve 353 may be coupled to the piston 322 to open and close at least one air supply hole 322A defined in the piston 322 by the reciprocating motion of the piston 322.

Specifically, when the piston 322 moves upward within the cylinder sleeve 341, the intake valve 353 may close at least one air supply hole 322A defined in the piston 322 by pressing force, and when the piston 322 moves downward within the cylinder sleeve 341, the intake valve 353 may open at least one air supply hole 322A by suction force to introduce the filtered air within the first stroke space S1 into the second stroke space S2.

Figure 14:
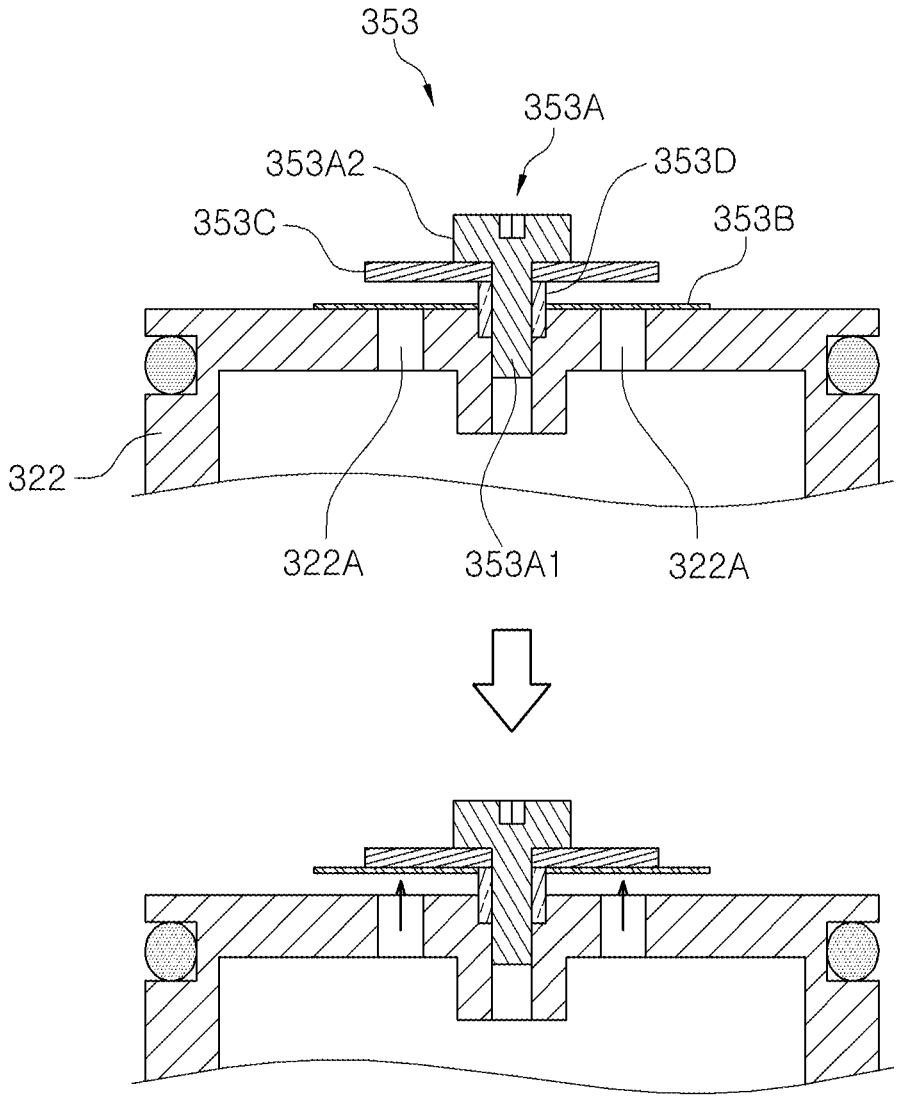
FIG. 14 is a schematic view illustrating a process of opening and closing an intake valve according to an embodiment of the present invention.

FIG. 14 is a schematic view illustrating a process of opening and closing an intake valve according to an embodiment of the present invention.

Referring to FIG. 14, the intake valve 353 may include a support bolt member 353A for intake (hereinafter, referred to as an intake support bolt member 353A), a valve disk 353B for intake (hereinafter, referred to as an intake valve disk 353B), a movement limiting disk 353C for intake (hereinafter, referred to as an intake movement limiting disk 353C), and a disk support member 353D for intake (hereinafter, referred to as an intake disk support member 353D).

The intake support bolt member 353A may include an intake bolt body 353A1 coupled to an upper central portion of the piston 322, and an intake bolt head 353A2 disposed at an upper end of the intake bolt body 353A1.

The intake valve disk 353B may be disposed between the intake bolt head 353A2 and the piston 322.

When the piston 322 moves upward, the intake valve disk 353B may be supported on a top surface of the piston 322 to close at least one air supply hole 322A, and when the piston 322 moves downward, the intake valve disk 353B may ascend along an axial direction of the intake bolt body 352A1 to open at least one passage 322A.

The intake movement limiting disk 353C may be coupled to the intake bolt body 353A1 and be disposed above the intake valve disk 353B.

When the intake valve disk 353B ascends, the intake movement limiting disk 353C may be in contact with a top surface of the intake valve disk 353B to restrict the movement of the intake valve disk 353B.

Here, the intake movement limiting disk 353C may have a predetermined diameter so as to be in sufficient contact with the top surface of the intake valve disk 353B to stably support the intake valve disk 353B.

For example, a relative ratio of the diameter of the intake valve disk 353B to a diameter of the intake movement limiting disk 353C may be about 1:1 or more and about 1:1.4 or less.

Thus, a sufficient support area of the intake movement limiting disk 353C with respect to the intake valve disk 353B may be secured to prevent the intake valve disk 353B from being deformed and damaged and minimize noise generated when contacting the intake movement limiting disk 353C.

If the intake movement limiting disk 353C is not provided, the ascending intake valve disk 353B is hung and supported by the intake bolt head 353A2. However, in this case, the sufficient support area may not be secured due to the relatively small diameter of the intake bolt head 353A2, and thus, whenever the intake valve disk 353B is in contact with the intake bolt head 353A2, a pressure of the intake valve disk 353A2 may be applied to be concentrated to a central portion of the intake valve disk 353B. Thus, the central portion of the intake valve disk 353*b* may be bent and deformed to cause cracks and noise.

The intake disk support member 353D may be coupled to an outer surface of the intake bolt body 353A1 to support a bottom surface of the intake movement limiting disk 353C along the axial direction of the intake bolt body 353A1.

Thus, the intake disk support member 353D may fix the intake movement limiting disk 353C.

Referring to FIGS. 2 and 10, the filtration filter 36 is coupled to the cylinder assembly 34 and is configured to filter air introduced into the cylinder assembly 34.

The filtration filter 36 may include a filter body 361 and an air inflow nozzle 362.

The filter body 361 may be disposed across the filter support groove 333A1, the first filter accommodation hole 342B, and the second filter accommodation hole 343B.

The filter body 361 may be provided in a cylindrical structure with an upper portion opened, so that an air inflow nozzle 362 is coupled to the upper portion thereof.

Thus, the filter body 361 may filter unfiltered air introduced through the opened upper portion.

The air inflow nozzle 362 may be detachably coupled to the second filter accommodation hole 343B.

The air inflow nozzle 362 may be coupled to an upper end of the filter body 361 to communicate with the filter body 361 and may introduce external unfiltered air into the filter body 361.

Figure 12:
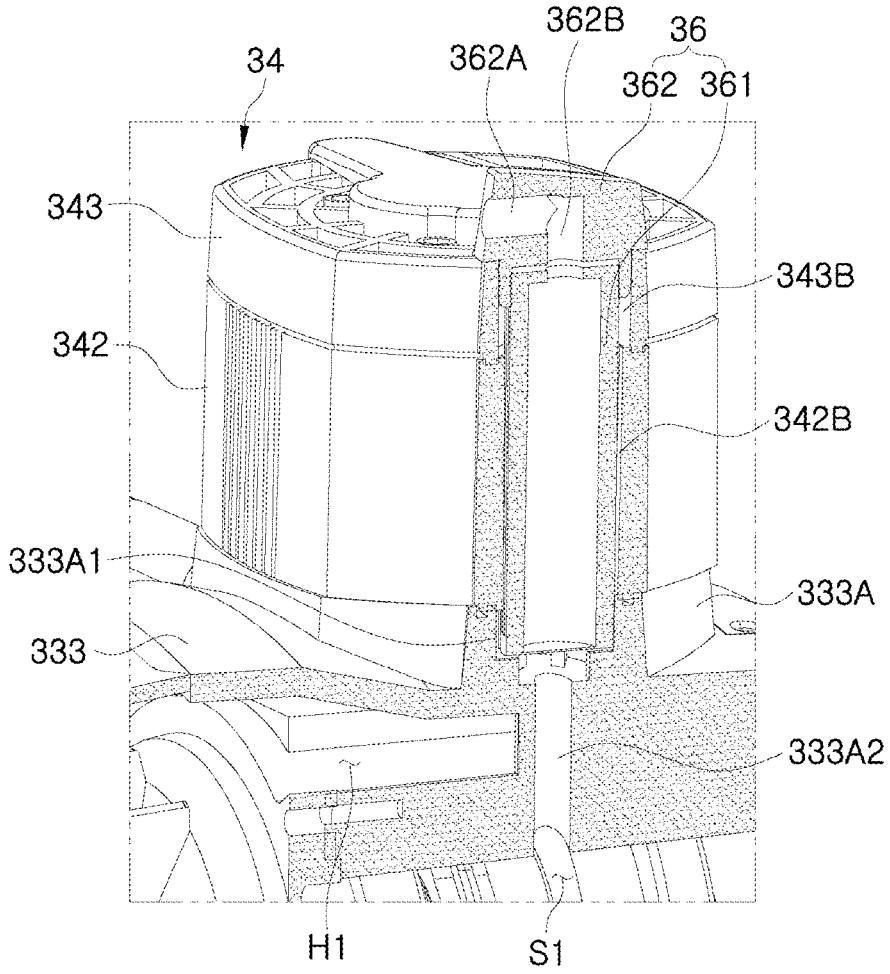
FIG. 12 is a cross-sectional view of a filtration filer according to an embodiment of the present invention.

FIG. 12 is a cross-sectional view of the filtration filer according to an embodiment of the present invention.

Referring to FIG. 12, the air inflow nozzle 362 may include a first air guide hole 362A communicating with the outside to guide unfiltered air introduced therein in the first direction and a second air guide hole 362B communicating with the first air guide hole 362A and the filter body 361 to guide the unfiltered air introduced therein through the first air guide hole 362A in the second direction different from the first direction so as to introduce the unfiltered air into the filter body 361.

Referring to FIGS. 2 and 4, the cooling fan 37 may be coupled to the crankshaft 31, be disposed on an end of the crank body 33, and be accommodated in the first heat dissipation space H1.

The cooling fan 37 may rotate by the crankshaft 31 to introduce the unfiltered air into the crank body 32 so as to flow.

Referring to FIGS. 1 and 2, this air compressor 1000 may further include an aftercooler (not shown) that cools the high-temperature compressed air, a dry unit and moisture separation unit (not shown) that remove moisture within the introduced compressed air through the aftercooler, a controller (not shown) that controls driving of the motor, a gauge (not shown) that displays an output pressure of the compressed air and a pressure within a tank 1, and a manipulation part (not shown) for use of the compressed air.

In addition, this air compressor 1000 may further include a motor mount unit (not shown) and a support (not shown).

The motor mount unit may be coupled to an upper portion of the tank 1 to support the driving motor 2 and may be configured so that a position of the driving motor 2 varies along an axial direction of the driving motor 2.

For example, the motor mount unit may include a base frame coupled to an upper portion thereof, a buffer member seated on the base frame, a mounting bracket coupled to a bottom surface of the driving motor 2 and supported on a top surface of the buffer member, and a coupling member coupled to pass through the base frame, the buffer member, and the mounting bracket to fix the buffer member and the mounting bracket on the base frame.

Here, the buffer member may include a buffer tube made of an elastic material to elastically support the base frame and the mounting bracket and a buffer coil accommodated in the buffer tube to elastically support the base frame and the mounting bracket.

The support may be coupled to a lower portion of the tank 1 and supported on the ground to absorb and disperse vibration transmitted through the tank 1.

The support may include a support frame coupled to a bottom surface of the tank 1 and a support structure coupled to the support frame and supported on the ground.

The support frame may include a vertical support part coupled to the bottom surface of the tank 1 and bent into an 'S' shape to be elastically deformed vertically when external force is applied and a horizontal support part which is coupled to a lower end of the vertical support part and to which the support structure is detachably coupled.

The support structure may include a height-adjustable member screw-coupled to the support frame to protrude to the outside of the support frame and a support member coupled to the height-adjustable member and supported on the ground to alleviate and disperse vibration transmitted through the support frame.

Here, the support member may include a disk-shaped first disk member coupled to the height-adjustable member, an elastic member coupled to an upper end of the first disk member to elastically support the horizontal support part, a second disk member spaced apart from the first disk member so as to be supported on the ground and having a diameter greater than that of the first disk member, a ring-shaped connection member that surrounds the first disk member and the second disk member and connects the first disk member to the second disk member, a vibration dispersion ball member provided in plurality between the first disk member and the second disk member and configured to perform a rolling motion between the first disk member and the second disk member when vibration is transmitted from the first disk member, and a plurality of auxiliary elastic members disposed along an edge of the second disk member to elastically support the horizontal support part.

In addition, the air compressor 1000 may further include a main body support unit (not shown).

The main body support unit may be coupled to a bottom surface of the crank body 33 and supported on the tank 1 to alleviate the vibration of the head module 3.

For example, the main body support unit may include a length-adjustable pole assembly coupled to the bottom surface of the crank body 33, an elastic support member accommodated in the length-adjustable pole assembly to elastically support the length-adjustable pole assembly, and a non-slip pad made of an elastic material, coupled to an end of the length-adjustable pole assembly, and supported on an outer surface of the tank 1.

According to the embodiment of the present invention, the tubular inner case 331, in which the air introduced into the stroke space is filtered by the filtration filter 36, and the piston assembly is accommodated, may be completely shielded by the driving motor 2 coupled to one end of the inner case 331 and the foreign substance inflow prevention cover 332 coupled to the other end of the inner case, thereby completely blocking the foreign substances from being introduced into the stroke space and blocking the noise by the foreign substance inflow prevention cover 332.

In addition, each of the crank case and the cylinder assembly 34, which define the stroke space, may be provided in the double-wall structure, and the inner case 331 disposed inside the outer case 333 may have the shielding structure, and thus, when the piston assembly 32 operates, the leakage of the noise generated in the stroke space to the outside may be minimized, and the leakage of the compressed air to the outside may be prevented.

In addition, since the coupling holes 335 and 336 are defined at one side of the crank case so that the crank case is coupled to or separated from the driving motor 2 in the state in which the piston assembly 32 is coupled to the driving motor 2, the difficulty of the assembly may be lowered to improve the work efficiency, the quick work and the precise work may be enabled, and the maintenance may be easy.

In addition, the external air may be forcibly circulated into the crank case and the cylinder assembly 34, each of which is provided in the double-wall structure, and the heat generated in the cylinder assembly 34 may be directly discharged to the outside using the cylinder block 342 to maximize the cooling performance.

In addition, the discharge movement limiting disk 352C, which supports the discharge valve disk 352B that opens the passage 351A to relieve the impact of the discharge valve disk 352B, may be disposed above the discharge valve disk 352B to prevent the discharge valve disk 352B from being deformed and damaged and minimize the noise generated when contacting the discharge movement limiting disk 352C.

In addition, the intake movement limiting disk 353C, which supports the intake valve disk 353B that opens the air supply hole 322A to relieve the impact of the intake valve disk 353B, may be disposed above the intake valve disk 353B to prevent the intake valve disk 353B from being deformed and damaged and minimize the noise generated when contacting the intake movement limiting disk 353C.

According to the embodiment of the present invention, the tubular inner case, in which the air introduced into the stroke space is filtered by the filtration filter, and the piston assembly is accommodated, may be completely shielded by the motor coupled to one end thereof and the foreign substance inflow prevention cover coupled to the other end thereof, thereby completely blocking the foreign substances from being introduced into the stroke space.

In addition, each of the crank case and the cylinder assembly, which define the stroke space, may be provided in the double-wall structure, and the inner case disposed inside the outer case may have the shielding structure, and thus, when the piston assembly operates, the leakage of the noise generated in the stroke space to the outside may be minimized, and the leakage of the compressed air to the outside may be prevented.

In addition, since the coupling hole is defined at one side of the crank case so that the crank case is coupled to or separated from the driving motor in the state in which the piston assembly is coupled to the driving motor, the difficulty of the assembly may be lowered to improve the work efficiency, the quick work and the precise work may be enabled, and the maintenance may be easy.

In addition, the external air may be forcibly circulated into the crank case and the cylinder assembly, each of which is provided in the double-wall structure, and the heat generated in the cylinder assembly may be directly discharged to the outside using the cylinder block to maximize the cooling performance.

In addition, the discharge movement limiting disk, which supports the discharge valve disk that opens the passage to relieve the impact of the discharge valve disk, may be disposed above the discharge valve disk to prevent the discharge valve disk from being deformed and damaged and minimize the noise generated when contacting the discharge movement limiting disk.

In addition, the intake movement limiting disk, which supports the intake valve disk that opens the air supply hole to relieve the impact of the intake valve disk, may be disposed above the intake valve disk to prevent the intake valve disk from being deformed and damaged and minimize the noise generated when contacting the intake movement limiting disk.

The effects according to the present invention are not limited to the details exemplified above, and further various effects are included within the present invention.

Although embodiments of the present invention have been described in more detail with reference to the accompanying drawings, the present invention is not necessarily limited to these embodiments, and various modifications may be made without departing from the technical spirit of the present invention. Thus, the embodiment of the present invention is to be considered illustrative, and not restrictive, and the technical spirit of the present invention is not limited to the foregoing embodiment. Therefore, the embodiments described above should be understood in all respects as illustrative and not restrictive. Therefore, the scope of the present disclosure is defined not by the detailed description of the invention but by the appended claims, and all differences within the scope will be construed as being included in the present disclosure.

Therefore, other implementations, other embodiments, and equivalents of the claims also fall within the scope of the following claims.

What is claimed is:

1. A head module for an air compressor, comprising:

a crankshaft configured to receive power so as to rotate;

a piston assembly comprising a connecting rod coupled to the crankshaft and a piston configured to reciprocate by the connecting rod;

a crank body in which the crankshaft is accommodated;

a cylinder assembly which is coupled to the crank body to communicate with the crank body and in which the piston is disposed;

a valve unit accommodated in the cylinder assembly and configured to be opened and closed according to a reciprocating motion of the piston;

a filtration filter coupled to the cylinder assembly and configured to filter air introduced into the cylinder assembly; and a cooling fan coupled to the crankshaft and disposed at an end of the crank body to rotate by the crankshaft so that unfiltered air is introduced into the crank body, wherein the crank body comprises:

a first stroke space in which the crankshaft is accommodated, and the filtered air is introduced through the cylinder assembly; and a first heat dissipation space which is isolated from the first stroke space and into which the introduced unfiltered air flows through the cooling fan, wherein the cylinder assembly comprises:

a second stroke space communicating with the first stroke space to accommodate the piston and the valve unit; and a second heat dissipation space which is isolated from the second stroke space to communicate with the first heat dissipation space and through which the unfiltered air passing through the first heat dissipation space flows to be discharged outside, wherein the crank body further comprises:

a tubular inner case defining the first stroke space and having an inner communication hole through which the first stroke space and the second stroke space communicate with each other, wherein the inner communication hole is disposed on an outer surface of the tubular inner case; and a tubular outer case surrounding a circumference of the tubular inner case, defining the first heat dissipation space, and including a mount through which the first heat dissipation space and the second heat dissipation space communicate with each other and to which the cylinder assembly is coupled, wherein one end of the tubular outer case is closed by the tubular inner case, and the mount is disposed on an outer surface of the tubular outer case.

2. The head module of claim 1, wherein the crank body further comprises:

a foreign substance inflow prevention cover coupled to an end of the tubular inner case to close the end of the tubular inner case and configured to support the crankshaft; and a fan cover coupled to the other end of the tubular outer case such that the cooling fan is disposed inside the tubular outer case, the fan cover including a spiral grill configured to flow the unfiltered air into the first heat dissipation space, wherein the cylinder assembly comprises:

a cylinder sleeve which communicates with the first stroke space and is disposed below the valve unit and in which the piston is disposed to be slidably movable, wherein the second stroke space is defined between the piston and the valve unit;

a cylinder block of which a portion penetrates the inner communication hole to surround the cylinder sleeve and another portion is coupled to an upper end of the mount such that one surface of the cylinder block is exposed outside, and in which first heat dissipation holes communicating with the first heat dissipation space are defined; and a cylinder head which is coupled to an upper end of the cylinder block to fix the valve unit and in which second heat dissipation holes communicating with the first heat dissipation holes are defined.

3. The head module of claim 2, wherein the piston includes at least one air supply hole therein, wherein the valve unit comprises:

a valve body disposed between the cylinder sleeve and the cylinder head and including at least one passage therein;

a discharge valve coupled to the valve body and configured to open the at least one passage by pressing force when the piston moves upward within the cylinder sleeve and to close the at least one passage by suction force when the piston moves downward within the cylinder sleeve; and an intake valve coupled to the piston and configured to close the at least one air supply hole by the pressing force when the piston moves upward within the cylinder sleeve and to open the at least one air supply hole by the suction force when the piston moves downward within the cylinder sleeve, wherein the discharge valve comprises:

a discharge support bolt member including a discharge bolt body coupled to a central portion of the valve body and a discharge bolt head disposed on an upper end of the discharge bolt body;

a discharge valve disk disposed between the discharge bolt head and the valve body, wherein the discharge valve disk is supported on a top surface of the valve body to close the at least one passage when the piston moves downward, and ascends along an axial direction of the discharge bolt body to open the at least one passage when the piston moves upward;

a discharge movement limiting disk which is coupled to the discharge bolt body so as to be disposed above the discharge valve disk when the discharge valve disk is supported on the top surface of the valve body, and is in contact with a top surface of the discharge valve disk to restrict movement of the discharge valve disk when the discharge valve disk ascends; and a discharge disk support member coupled to an outer surface of the discharge bolt body and configured to support a bottom surface of the discharge movement limiting disk along the axial direction of the discharge bolt body so as to fix the discharge movement limiting disk, wherein the intake valve comprises:

an intake support bolt member including an intake bolt body coupled to an upper central portion of the piston and an intake bolt head disposed at an upper end of the intake bolt body;

an intake valve disk disposed between the intake bolt head and the piston, wherein the intake valve disk is supported on a top surface of the piston to close the at least one air supply hole when the piston moves upward, and ascends along an axial direction of the intake bolt body to open the at least one air supply hole when the piston moves downward;

an intake movement limiting disk which is coupled to the intake bolt body so as to be disposed above the intake valve disk when the intake valve disk is supported on the top surface of the piston, and is in contact with a top surface of the intake valve disk to restrict movement of the intake valve disk when the intake valve disk ascends; and an intake disk support member coupled to an outer surface of the intake bolt body and configured to support a bottom surface of the intake movement limiting disk along the axial direction of the intake bolt body so as to fix the intake movement limiting disk.

* * * * *